US006027315A

United States Patent [19]

Hogan

[11] Patent Number: 6,027,315

[45] Date of Patent: Feb. 22, 2000

[54] INLET CONTROL VALVE FOR COMPRESSORS

[75] Inventor: James Victor Hogan, Ladysmith, Canada

[73] Assignee: VMAC Division of Mangonel Corporation, Canada

[21] Appl. No.: 08/922,383

[22] Filed: Sep. 3, 1997

[51] Int. Cl.[7] ..... F04B 49/22

[52] U.S. Cl. ..... 417/295; 137/523; 251/63.6

[58] Field of Search ..... 417/295, 298, 417/411; 137/522, 523; 251/63.4, 63.6

[56] References Cited

U.S. PATENT DOCUMENTS 4,362,475 12/1982 Seitz ..... 417/295
4,869,289 9/1989 Hrabal ..... 137/512.1
5,388,967 2/1995 Firnhaber et al. ..... 417/295
5,456,582 10/1995 Firnhaber et al. ..... 417/295
5,533,873 7/1996 Kindl ..... 417/295

*Primary Examiner*—Charles G. Freay
*Assistant Examiner*—Ehud Gartenberg
*Attorney, Agent, or Firm*—C. A. Rowley

[57] ABSTRACT

A simplified control valve system is provided wherein a single multi-functional orifice provides the required bleed from the control cylinder chamber as well as the required venting of the system for blow down. Preferably, the control line will be an oil scavenger line and the multi-functional orifice will be positioned in the inlet passage of the valve to the compressor and a suitable oil sump positioned adjacent to the multi-optional orifice to collect any oil blown there through during blow down. The valve of the present invention is also adjustable by rotating the valve stem to which the control piston is connected.

8 Claims, 4 Drawing Sheets

INLET CONTROL VALVE FOR COMPRESSORS

FIELD OF INVENTION

The present invention relates to a control valve, more particularly, the present invention relates to a simplified control valve for controlling the operation of a screw compressor.

BACKGROUND OF THE INVENTION

The use of fluid under pressure from the high pressure side of the compressor to control the operation of the inlet valve to the compressor and thereby control the operation of the compressor is very well known. Some recent examples of such regulators are shown for example, in recently issued U.S. Pat. No. 5,388,967 issued Feb. 14, 1995 and U.S. Pat. No. 5,456,582 issued Oct. 10, 1995, both to Firnhaber et al. These controls require a number of different orifices and control lines to operate the system and pneumatically control the position of an inlet valve for the compressor in accordance with the air pressure in the receiver.

U.S. Pat. No. 5,533,867 issued Jul. 9, 1996 to Kinds discloses a similar type control that uses a pair of opposed springs to more accurately adjust the operating pressure.

U.S. Pat. 4,362,475 issued Dec. 7, 1982 to Seitz discloses a control system using air under high pressure from the receiver to move a piston and provides a blow down orifice leading into the inlet passage valve (blow down is the reduction in pressure when the compressor is shut down). This system also includes a bypass orifice as well as two other orifice type passages bringing air under receiver pressure into the control piston chamber.

BRIEF DESCRIPTION OF THE PRESENT INVENTION

It is an object of the present invention to provide a simplified control system for controlling the inlet valve for a compressor particularly a screw type air compressor.

It is also an object of the present invention to provide an inlet valve compressor control wherein the required pressure to close the inlet valve is easily adjusted.

Broadly, the present invention relates to an inlet control valve for a compressor comprising a valve housing defining an inlet passage and an outlet passage, a valve seat means separating said inlet passage from said outlet passage, cooperating valve means cooperating with said valve seat for opening and closing said inlet control valve, a piston means, a piston chamber receiving said piston means, means for slidably connecting said piston means to said cooperating valve means, means biasing said cooperating valve means to resist movement of said cooperating valve means toward said seat means, a multi-function orifice means opening into said inlet passage adjacent to said valve seat means, a connecting passage interconnecting said multi-function orifice means and said piston chamber for fluid flow therebetween, means connecting said connecting passage to a line for fluid flow from a high pressure side of said compressor for delivering compressed fluid compressed by the compressor to said connecting passage, said multi-function orifice means being sized to function as a continuous bleed orifice from said line compatible with operation of said piston in said piston chamber and a blow down orifice at appropriate times in the operation of said inlet control valve.

Preferably, said line is an oil scavenging line and said housing further comprises an oil sump positioned in said inlet passage to receive oil blown from said multi-functional orifice during blow down.

Preferably, said cooperating valve means includes a control pressure adjustment means for changing the pressure required in said piston chamber to move said cooperating valve means into seating relationship with said seat means.

Preferably, said means for slidably connecting said piston means to said cooperating valve means comprises a valve stem extending axially of said cooperating valve means, and said control pressure adjustment means includes a sleeve concentric with said valve stem, coupling means, coupling said valve stem and said concentric sleeve for transferring of rotary motion from said valve stem to said sleeve while permitting the relative axial movement between said sleeve and said stem, threads on said sleeve cooperating with cooperating threads in said housing, said means biasing comprising a spring interposed between said piston means and said concentric sleeve so that axial movement of said concentric sleeve relative to said housing adjusts the pressure required to be applied by said piston to move said cooperating valve means into seating engagement with said seat means.

Preferably, said means slidably connecting said piston means to said cooperating valve means comprises a valve stem extending axially of said cooperating valve means, a cavity in said piston means in which one end of said stem is received and said control pressure adjustment means includes an adjustable abutment means projecting into a bottom of said cavity means for adjusting the degree of projection of said adjustable abutment means into said cavity, a sleeve concentric with said valve stem, said means biasing comprising a spring interposed between said piston means and said concentric sleeve.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
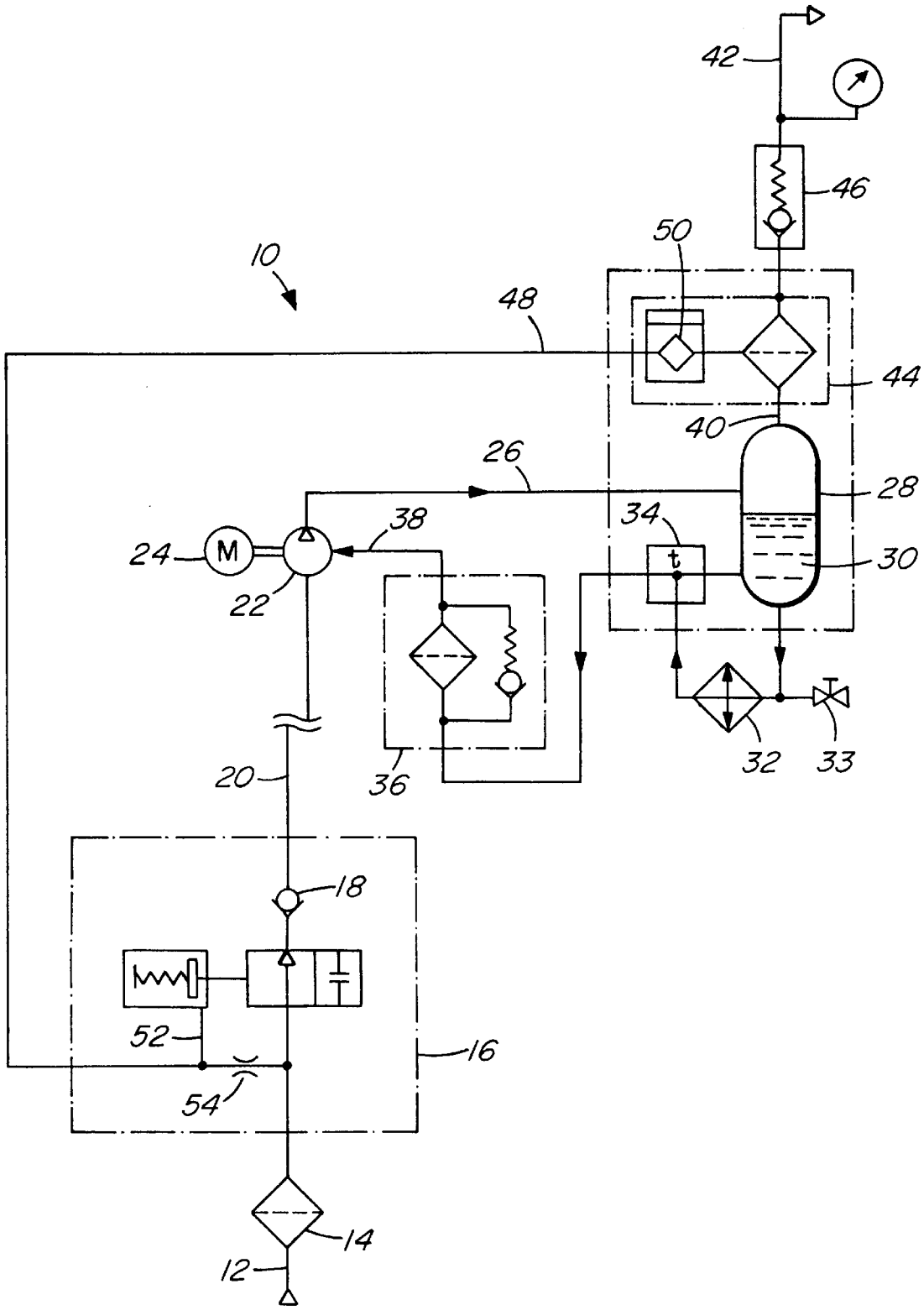
FIG. 1 is a schematic illustration of the fluid connections of the present invention.

As shown in FIG. 1, air enters the compressor system 10 via the line 12 and passes through an air filter 14 into the inlet control valve 16 which forms the subject matter of the present invention but is only schematically illustrated in FIG. 1. When the valve 16 is in the position schematically illustrated in FIG. 1, i.e. in the open position, air passes through the check valve 18 and line 20 to the compressor 22. The line 20 normally will be very short as the valvel6 is intended to be positioned on the housing of the compressor 22.

The compressor 22 preferably is a screw type compressor and is driven by a motor 24. A mixture of oil and compressed fluid (air) leaves the compressor 22 and passes via line 26 to a receiver 28 which also functions as an oil separator and thus contains oil as indicated at 30.

The oil is separated from the compressed fluid in the conventional two stage manner, one for larger oil droplets and bulk oil and a second for small i.e. sub-micron size oil droplets.

Most of the oil is in the form of large droplets or bulk liquid is separated by passage of the mixture through a series of baffles to which the oil adheres and flows to the bottom of the receiver 28 to form the pool 30. The oil from the pool 30 is adjusted to proper temperature by the cooler or the like 32 and temperature sensor 34 and is delivered through filter 36 into an intermediate pressure point in the compressor 22 via line 38. A suitable drain connection schematically indicated 33 is provided to drain the pool 30 when required.

The sub-micron size oil droplets are carried in the compressed fluid (air) leaving the receiver 28 via line 40 leading to the main outlet line 42 and are separated in an oil separator schematically indicated 44. The small droplets of oil coalesce on coalescing elements to form a pool in the separator 44 and is delivered through screen 50 and then back to the valve 16 via the scavenging line 48.

Oil vapor passes through both oil separation stages and leaves the system in the compressed fluid in line 42.

A minimum pressure check valve 46 ensures there is at least a minimum air pressure in the line 42 or the system will not deliver fluid under pressure .

Scavenging fluid (air) under system output pressure from the oil filter 44 i.e. in line 48 is used to control the operation of the valve 16 and provide a controlled outlet for blow down as will be described hereinbelow, i.e. the line 48 delivers fluid (air) at operating pressure and containing oil separated in the separator 44 to the control piston chamber (described below) as indicated by the branch 52 and to a multi-functional orifice 54 that bleeds fluid into the intake side of the valve 16 as will be more fully described hereinbelow.

Figure 2:
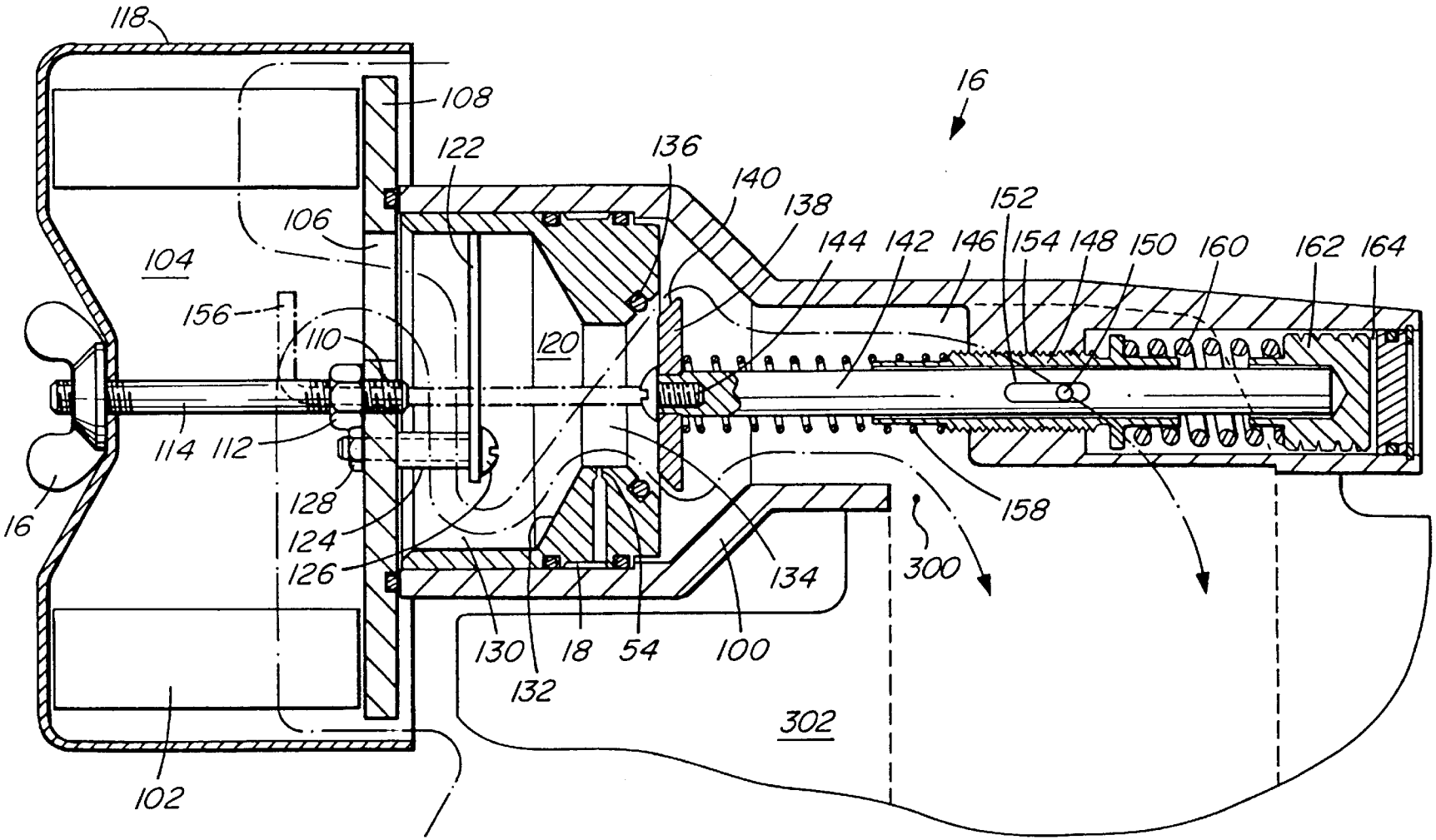
FIG. 2 is a longitudinal cross section through an inlet control valve constructed in accordance with the present invention.

As shown in FIG. 2, the inlet control valve 16 is formed by a housing 100 in which is mounted a suitable adjustable valve system as will be described. Air enters the system, flows as indicated by the dotted arrows through the annular air filter 102 into a central chamber 104 and through the passage 106 in a base plate 108 on which the filter 102 is mounted. The base plate 108 is formed with an axial hole 110 and is provided with a threaded nut 112 that cooperates with a threaded stud 114 which also has threads at its opposite end to receive wing nut 116 that clamps the outer housing 118 in place over the filter 102 to ensure that air flow into the passage 104 must pass through the filter 102.

The passage 106 leads to an inlet passage 120 in the valve 16 but the air is directed to flow downward via a baffle 122 fixed in the valve housing 100 and spaced from the partition wall or base wall 108 via a pair of spaced spacers 124. Each spacer 124 is held in place by a bolt 126 passing through the partition 108 and a cooperating nut 128. It will be apparent that a sump or chamber 130 is formed beneath the partition or deflector 122 so that the air flow flows down into the chamber 130 and then up and around the tapered inlet formed as indicated at 132 leading to the throat 134 of the valve 16.

A suitable valve seat formed by O-ring 136 forms a seat means for the cooperating valve 138 which cooperates with the seat 136 to close the valve at the appropriate time. The cooperating valve 138 has a poppet or valve sealing element 140 held on a valve stem 142 via an appropriate bolt 144. The valve stem 142 extends axially along a portion of the outlet passage 146 of the valve 16.

The stem 142 passes through a concentric sleeve 148 to which it is coupled via a radial pin 150 that is received within an axial slot 152 in the sleeve 148 to permit relative axial movement between the sleeve 148 and the valve stem 142 while transmitting rotary motion therebetween. The slot 152 has been shown formed in the sleeve 148 with the pin being connected to the stem 142 and extending substantially diametrically across the sleeve 148.

The outside of the sleeve 148 is threaded and is engaged with cooperating thread formed in the housing 100 as indicated at 154 so that rotation of the sleeve 148 relative to the housing 100 via the cooperation of the threads as indicated at 154 axially moves the sleeve 148 relative to the housing 100. This axial adjustment is attainable by removing the stud 114 and passing a wrench shown in dot-dash line 156 into a suitable socket at the end of the bolt 144 and rotating the valve 138 and thus, the valve stem 142 which via the pin connection 150, 152 causes the sleeve 148 to rotate and thereby turn the sleeve 148 in the threaded connection 154 and move the sleeve 148 axially relative to the housing 100.

Positioned between the sleeve 148 and the seating end or poppet 140 of the valve 138 is a light spring 158 which tends to bias the poppet 140 into cooperation with the seat 136 and close the valve 16.

A second heavier spring 160 extends between the opposite end of the sleeve 148 and a piston 162 slidably connected (e.g. by a slip fit or the like) to the axial end of the stem 142 remote from the poppet 140. This piston 162 is received in a piston chamber 164 so that fluid pressure in the chamber 164 tends to close the poppet 140 against the seat 136 with the fluid pressure necessary to close the valve 16 i.e. seat the poppet 140 against the seat 136 being dependent on the degree of compression of the spring 160.

Figure 3:
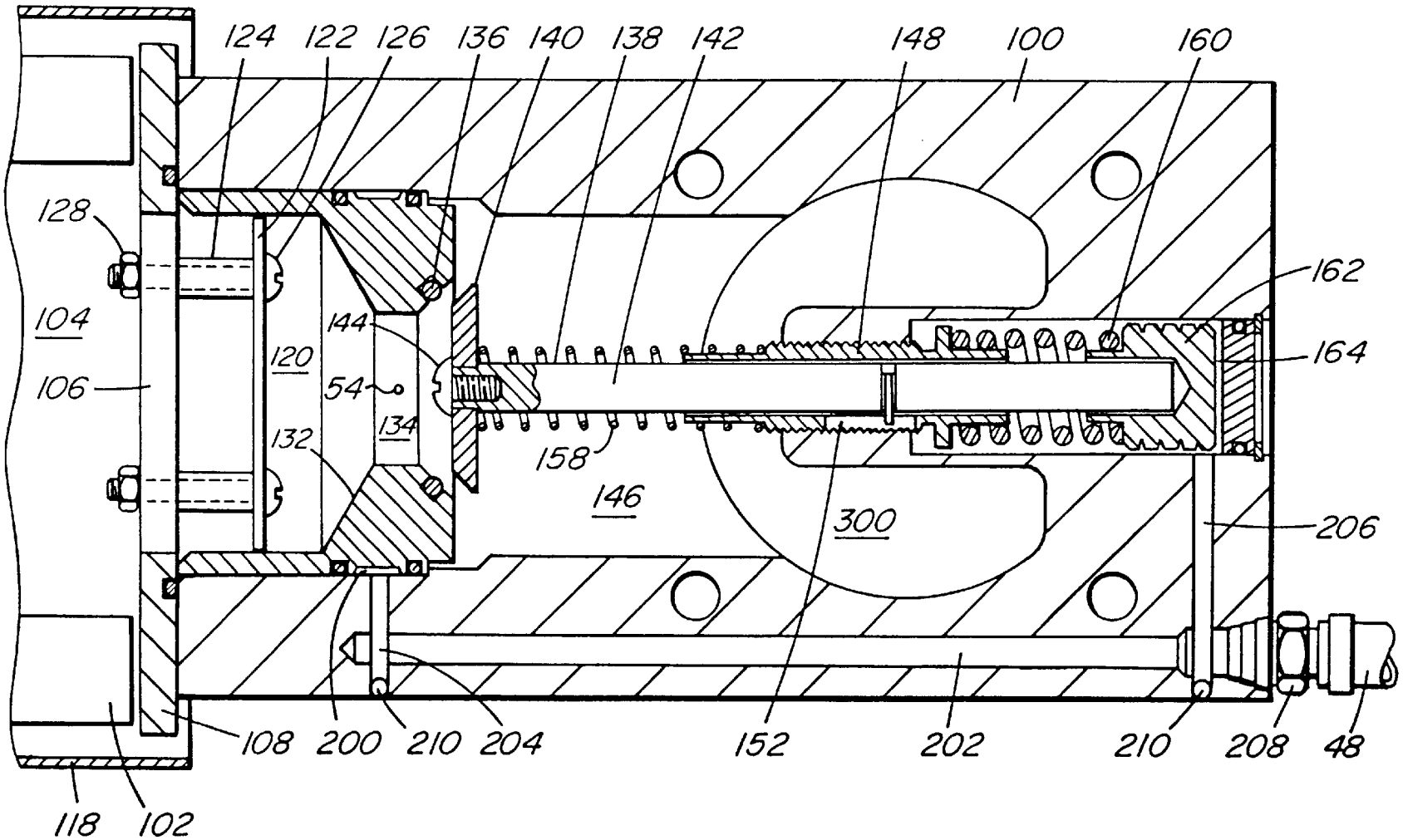
FIG. 3 is a longitudinal cross section through an inlet control valve showing a view at 90° to FIG. 2, to illustrate the control fluid connections in the valve.

Referring now to FIG. 3, (parts have been omitted for clarity) the passage structure through the valve 16 is illustrated. As shown, to deliver fluid to the orifice 54, an annular passage 200 is provided which connects an interconnecting passage 202 in the valve housing 100 to the orifice 54 via a radial branch passage 204 extending from the connecting passage 202. A radial passage 206 connects to the interconnecting passage 202 to the piston chamber 164. The connecting passage 202 is connected to the to scavenging line 48 via the coupler 208. The outboard ends of the passages 204 and 206 are each plugged by a plug 210.

It is preferred that the housing 100 be constructed in a manner to conform with the compressor to which it is being applied and it is obviously evident that the sump 130 for reasons described hereinbelow must be at the bottom portion of the inlet passage 120 when the valve 16 is mounted in operative position.

During operation, the fluid line 48 delivers a mixture of compressed fluid (air) and scavenged oil to the piston chamber 164 and to the orifice 54. By volume the mixture is predominantly compressed fluid (air) with a small amount of oil. The flow through the orifice 54 provides a constant bleed from the system carrying oil into the inlet passage 120 preferably adjacent to the throat 134 thereby reintroducing the oil from separator 44 into the compressor air entry flow.

When the system is under pressure sufficiently high and usage of compressed air sufficiently low, the chamber 164 will in spite of the bleed through the multi-function orifice 54 develop sufficient pressure to compress the spring 160 and seat the poppet 140 against the seat 136. When compressed air is used i.e. the pressure of the compressed air reduces sufficiently, the pressure in the chamber 164 is also reduced permitting the poppet 140 to open, i.e. separate from the seat 136 and permit the passage of air to the compressor 22.

On blow down, when the compressor 22 is turned off, it is necessary to permit the air under pressure to be vented. This is accomplished with the present invention through the same multi-functional orifice 54 used to re-inject scavenged oil during normal operation back into the air flow to the compressor 22.

During blow down the poppet 140 is firmly seated against the seat 136 to convert the valve 16 into a check valve (schematically indicated at 18 in FIG. 1) under the action of the substantial back pressure at the exhaust from the valve i.e. entry 300 into the compressor 302. Immediately upon compressor rotor stoppage the light spring 158 promotes quick closure and minimum blowby of oil spray.

Because the line 48 is a scavenger line it carries some oil that is ejected through the orifice 54. When the valve 16 is open, this oil, as above described, is reentrained and carried to the compressor by the flowing air and thus functions to aid in lubricating the compressor 22. During blow down on closing of the system, the valve 16 is closed so that any oil blown out through the orifice 54 is not carried back into the system but rather falls and accumulates in the sump 130. This sump 130 does not have to be very big since the amount of oil returning is relatively small.

Thus in operation during blowdown the compressed air passes via coalescing separator 44 and the line 48 through the orifice 54 into the chamber 120 and then out through the filter 102. It is preferred to interpose the baffle 122 between the orifice 54 and the filter 102 to minimize the opportunity for oil to contaminate the filter 102. The baffle 122 forces the incoming air toward the bottom of the sump 130 to better ensure entrainment of any oil in the sump 130.

On start up, this oil contained within the sump 130 is entrained in the incoming air passing through the valve 16 and thus is dissipated by reapplication to the compressor 22 as described above.

It will be apparent that the size of orifice 54 since it has more than one function, i.e. it is multi-functional, must be carefully selected. It has been found that an orifice 54 having a diameter of 0.03 inch is satisfactory for compressors with throughput up to about 70 standard cubic feet per minute. For compressors with different throughputs the size should be adjusted accordingly i.e. as the throughput is increased the orifice size should be increased generally proportionately.

A single orifice 54 has been shown. However, if desired, a plurality of orifice of corresponding smaller dimensions may be used in place of the single orifice. However, they would function in unison in effect as a single orifice and must all be properly positioned relative to the sump 130.

Figure 4:
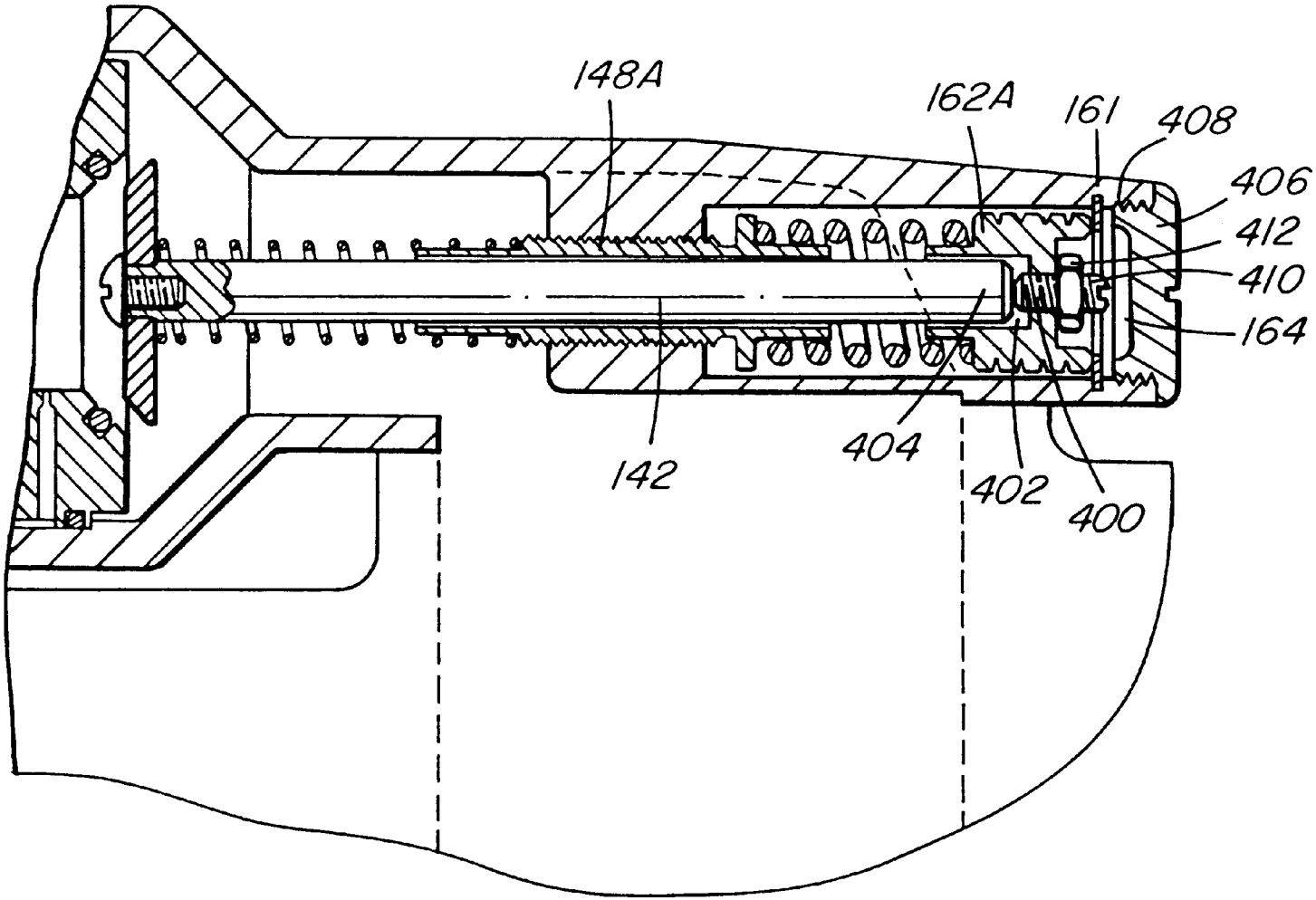
FIG. 4 is a partial sectional view similar to FIG. 2 but illustrating a modified version of the pressure adjustment system.

FIG. 4 shows a modified pressure adjustment system wherein the moveable sleeve 148 is replaced by a fixed sleeve 148A that acts as a valve guide for the valve stem 142. The fixed sleeve 148A fixes the pressure of the spring 160 between the sleeve 148A and the piston 162A which replaces the piston 162. The spring 160 tends to hold the piston 162A in its rearward position against the annular stop 161.

The piston 162A is provided with an axially adjustable set screw 400 that projects into the axial chamber 402 in the piston 162A and into which the end 404 of the stem 142 is received. The space between the end of the set screw 400 in the chamber 402 and the end 404 of the valve stem 142 defines the distance the piston 162A must travel before it begins to move the poppet 140 toward the seat 136 and thus the amount of movement of the piston 162A necessary to close the valve 16.

Adjustment of the required pressure in chamber 164 necessary to close the valve 16 is attained by removal of the end cover 406 of the cylinder 164 via its threaded connection 408 to expose the socket end 410 of the set screw 400. After loosening of the lock nut 412 the set screw 400 may be adjusted via a suitable wrench to extend further (reduce pressure required to close the valve 16) or less into the chamber 402 (increase the pressure required to close the valve 16). After the adjustment is completed the locking nut is tightened to fix the adjustment.

Once the pressure adjustment has been made the embodiment of FIG. 4 operates in essentially the same manner as the earlier described embodiment.

It will be noted that with the present invention the housing or casing 100 of the inlet valve 16 may be made to conform directly with the adjacent surface of the compressor housing 302 so that the outlet from the valve 16 and the inlet to the compressor 302 are essentially the same passage 300 (see FIG. 2).

Having described the invention, modifications will be evident to those skilled in the art without departing from the scope of the invention as defined in the appended claims.

I claim:

1. An inlet control valve for a compressor comprising a valve housing defining an inlet passage and an outlet passage, a valve seat separating said inlet passage from said outlet passage, cooperating valve cooperating with said valve seat for opening and closing said inlet control valve, a piston a piston, chamber receiving said piston, a slidable connection connecting said piston to said cooperating valve, a multi-function orifice opening into said inlet passage adjacent to said valve seat, an oil sump positioned in said inlet passage adjacent to said multifunctional orifice in postion to receive oil blown from said multi-functional orifice during blow down and to permit said oil to be entrained in air passing through said inlet passage, a connecting passage interconnecting said multi-function orifice and said piston chamber for fluid flow therebetween, means connecting said connecting passage to a line for fluid flow from a high pressure side of said compressor for delivering compressed fluid compressed by the compressor to said connecting passage, said multi-function orifice means being sized to function as a continuous bleed orifice from said line and as a blow down orifice at appropriate times in the operation of said inlet control valve.

2. An inlet control valve for a compressor as defined in claim 1 wherein said line is an oil scavenging line and wherein said passage is formed with a narrowed throat section adjacent to said seat and wherein said multifunctional orifice opens into said throat section.

3. An inlet control valve for a compressor as defined in claim 1 wherein said cooperating valve includes a control pressure adjustment means for changing the pressure required in said piston chamber to move said cooperating valve into seating relationship with said seat.

4. An inlet control valve for a compressor as defined in claim 2 wherein said cooperating valve includes a control pressure adjustment means for changing the pressure required in said piston chamber to move said cooperating valve into seating relationship with said seat.

5. An inlet control valve for a compressor as defined in claim 3 wherein said slidable connection connecting said piston means to said cooperating valve comprises a valve stem extending aloe a longitudinal axis of said cooperating valve and said control pressure adjustment means includes a sleeve concentric with said valve stem, coupling means, coupling said valve stem and said concentric sleeve for transferring of rotary motion from said valve stem to said sleeve while permitting relative movement parallel to said longitudinal axis between said sleeve and said stem, threads on said sleeve cooperating with cooperating threads in said housing, means biasing said cooperating valve to resist movement of said cooperating valve toward said seat, said means biasing comprising a spring interposed between said piston means and said concentric sleeve so that movement of said concentric sleeve parallel to said longitudinal axis relative to said housing adjusts the pressure required to be applied by said piston means to move said cooperating valve into seating engagement with said seat.

6. An inlet control valve for a compressor as defined in claim 4 wherein said sidable connection connecting said piston means to said cooperating valve comprises a valve stem extending along a longitudinal axis of said cooperating valve, and said control pressure adjustment means includes a sleeve concentric with said valve stem, coupling means, coupling said valve stem and said concentric sleeve for transferring of rotary motion from said valve stem to said sleeve while perrmitting relative movement parallel to said longitudinal axis between said sleeve and said stem, threads on said sleeve cooperating with cooperating threads in said housing, means biasing said cooperating valve to resist movement of said cooperating valve toward said seat, said means biasing comprising a spring interposed between said piston means and said concentric sleeve so that movement of said concentric sleeve parallel to said longitudinal axis relative to said housing adjusts the pressure required to be applied by said piston means to move said cooperating valve into seating engagement with said seat.

7. An inlet control valve for a compressor as defined in claim 3 wherein said slidable connection connecting said piston means to said cooperating valve comriprises a valve stem extending axially of said cooperating valve, a cavity in said piston means in which one end of said stem is received and said control pressure adjustment means includes an adjustable abutment projecting into a bottom of said cavity, means for adjusting the degree of projection of said adjustable abutment into said cavity, a sleeve concentric with said valve stem, means biasing said cooperating valve to resist movement of said cooperating valve toward said seat, said means biasing comprising a spring interposed between said piston means and said concentric sleeve.

8. An inlet control valve for a compressor as defined in claim 4 wherein said sidable connection connecting said piston means to said cooperating valve comprises a valve stem extending axially of said cooperating valve, a cavity in said piston means in which one end of said stem is received and said control pressure adjustment means includes an adjustable abutment projecting into a bottom of said cavity, means for adjusting the degree of projection of said adjustable abutment into said cavity, a sleeve concentric with said valve stem, means biasing said cooperating valve to resist movement of said cooperating valve toward said seat, said means biasing comprising a spring interposed between said piston means and said concentric sleeve.

* * * * *